United States Patent [19]

Marcellus

[11] Patent Number: 4,638,524

[45] Date of Patent: Jan. 27, 1987

[54] CREOSOTE CUTTER MOUNTING BRACKET ASSEMBLY

[76] Inventor: Leland D. Marcellus, P.O. Box 657, Unadilla, N.Y. 13849

[21] Appl. No.: 573,321

[22] Filed: Jan. 24, 1984

[51] Int. Cl.[4] ..... F23J 3/00

[52] U.S. Cl. ..... 15/249; 15/243; 254/390

[58] Field of Search ..... 15/249, 243, 163; 126/16; 166/170; 254/324, 334, 380, 390, 411, 413, 415, 417

[56] References Cited

U.S. PATENT DOCUMENTS

| | | | |
|---|---|---|---|
| 727,995 | 5/1903 | Olson | 15/163 |
| 1,070,662 | 8/1913 | Bedford et al. | 15/249 |
| 1,422,001 | 7/1922 | Sharp et al. | 15/249 |
| 4,208,756 | 6/1980 | Smith | 15/243 |
| 4,340,989 | 7/1982 | Rotondi et al. | 15/249 |

FOREIGN PATENT DOCUMENTS

| | | | |
|---|---|---|---|
| 543 | of 1897 | United Kingdom | 15/249 |
| 162194 | 5/1920 | United Kingdom | 15/249 |

*Primary Examiner*—Chris K. Moore
*Attorney, Agent, or Firm*—Don E. Ferrell

[57] ABSTRACT

A mounting bracket assembly for a creosote cutter includes a mounting bracket which may be fixedly secured to a chimney so as to extend across the flue. Fastening bands wrapped around the chimney are directed through guides forming a part of the bracket, and a freely moving cylindrically-shaped section of conduit which functions as a pulley is centrally positioned on the bracket. A creosote cutter pull chain is positioned over the conduit and downwardly into the flue of the chimney. The pull chain both supports the cutter and operates as the means by which the cutter is selectively moved upwardly and downwardly within the flue.

18 Claims, 5 Drawing Figures

CREOSOTE CUTTER MOUNTING BRACKET ASSEMBLY

BACKGROUND OF THE INVENTION

1. Field of the Invention

The present invention relates generally to creosote cutters for cleaning creosote out of chimneys and more particularly pertains to a new and improved mounting bracket assembly which is designed primarily for supporting creosote cutters which are permanently installed within a chimney flue.

2. Description of the Prior Art

Creosote cutters and other types of chimney cleaners are well known in the prior art. In this connection, reference is made to U.S. Pat. No. 4,409,703 which issued to the present inventor on Oct. 18, 1983 and the disclosure of which is incorporated herein by reference. The creosote cutter disclosed in the inventor's prior patent is permanently positioned within a chimney flue and is movably supported from a pulley through the use of a flexible chain or the like. An operator may manually move the chain over the pulley to effectively move the creosote cutter up and down within the chimney, while in the various embodiments of the invention, the cutter may be operated from an exterior position outside of the chimney, such as at ground level, or alternatively, the flexible pulling chain may be directed downwardly through the chimney so as to permit an operator to operate the cutter through an interiorly positioned access or cleanout door normally provided with coal, wood and similar types of fire boxes.

Additionally disclosed in the inventor's prior patent are various embodiments of supporting and guiding mounting bracket assemblies which, although each functions precisely in the desired manner, are so constructed as to require the manufacture and assembly of a plurality of separable parts. Through continued experimentation, the inventor of the present invention has determined that it is desirable to simplify the construction of the mounting and supporting bracket assemblies associated with the embodiments of his prior invention, and it is to such improvements that the present invention is directed.

SUMMARY OF THE INVENTION

The general purpose of the present invention, which will be described subsequently in greater detail, is to provide a chimney cleaner mounting bracket assembly which possesses all of the advantages of the prior art chimney cleaner mounting bracket assemblies and none of the disadvantages. To attain this, the chimney cleaner mounting bracket assembly forming the present invention utilizes a bracket mountable to a topmost portion of a chimney, such bracket serving to support a creosote cutter or cutter bar normally retained within the flue of the chimney. More specifically, the bracket is of an integral construction and is mounted to the top of the chimney through the use of at least one strip of banding iron which is tightly fastened around a periphery of the chimney or its flue. The bracket includes banding guides, through which the banding iron is directed to retain the bracket in position, and further includes orthogonally-positioned support plates which are integrally or otherwise fixedly attached to the bracket. The support plates are designed to bear against a topmost portion of the chimney, thus to support the weight of a creosote cutter supported by the bracket.

The bracket further includes a substantially centrally positioned roller or pulley assembly which essentially consists of a piece of cylindrical pipe freely supported by and rotatable on the bracket, while being held in position by a pair of fixedly positioned stops. The creosote cutter supporting chain is directed over the pipe section with the pipe then being rotatably movable on the bracket in response to a movement of the chain, whereby the pipe section functions as the aforementioned pulley or roller.

The invention further includes a novel attachment bracket which functions to connect the creosote cutter to its supporting chain. The bracket consists of a plate having a metallic loop riveted thereto, with the metallic loop extending through a chain link. While the metallic loop is attached to a topmost surface of the plate, a further metallic loop is interconnected to a bottommost portion of the plate and is bent substantially into the form of an eye. A cutter support member includes a metallic loop directed through the eye so as to complete the attachment of the cutter to the supporting chain.

It is therefore an object of the present invention to provide a creosote removing chimney cleaner mounting bracket assembly that has all of the advantages of the prior art chimney cleaner mounting bracket assemblies and none of the disadvantages.

Another object of the present invention is to provide a creosote removing chimney cleaner mounting bracket assembly which is simply constructed and which is designed with a minimum of separable and moving parts.

Yet another object of the present invention is to provide a creosote removing chimney cleaner mounting bracket assembly which may be efficiently, easily and economically manufactured.

Still another object of the present invention is to provide a creosote removing chimney cleaner mounting bracket assembly that provides for a reliable and durable operable attachment of a chimney cleaner within a chimney.

A further object of the present invention is to provide a creosote removing chimney cleaner mounting bracket assembly which may be easily and rapidly attached to existing chimney structures.

Even another object of the present invention is to provide a creosote removing chimney cleaner mounting bracket assembly that may be permanently attached to an existing chimney.

A still further object of the present invention is to provide a creosote removing chimney cleaner mounting bracket assembly that facilitates the operation of the associated chimney cleaner by a user with a minimum of time and effort.

Even another object of the present invention is to provide a creosote removing chimney cleaner mounting bracket assembly which is characterized by a portable and lightweight construction.

Still even a further object of the present invention is to provide a creosote removing chimney cleaner mounting bracket assembly which is susceptible of a low cost of manufacture with regard to both materials and labor, and which accordingly is then susceptible of low prices of sale to the consuming public, thereby making such devices economically available to the buying public.

Even still another object of the present invention is to provide a creosote removing chimney cleaner mounting bracket assembly which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

DESCRIPTION OF THE PREFERRED EMBODIMENT

Figure 1:
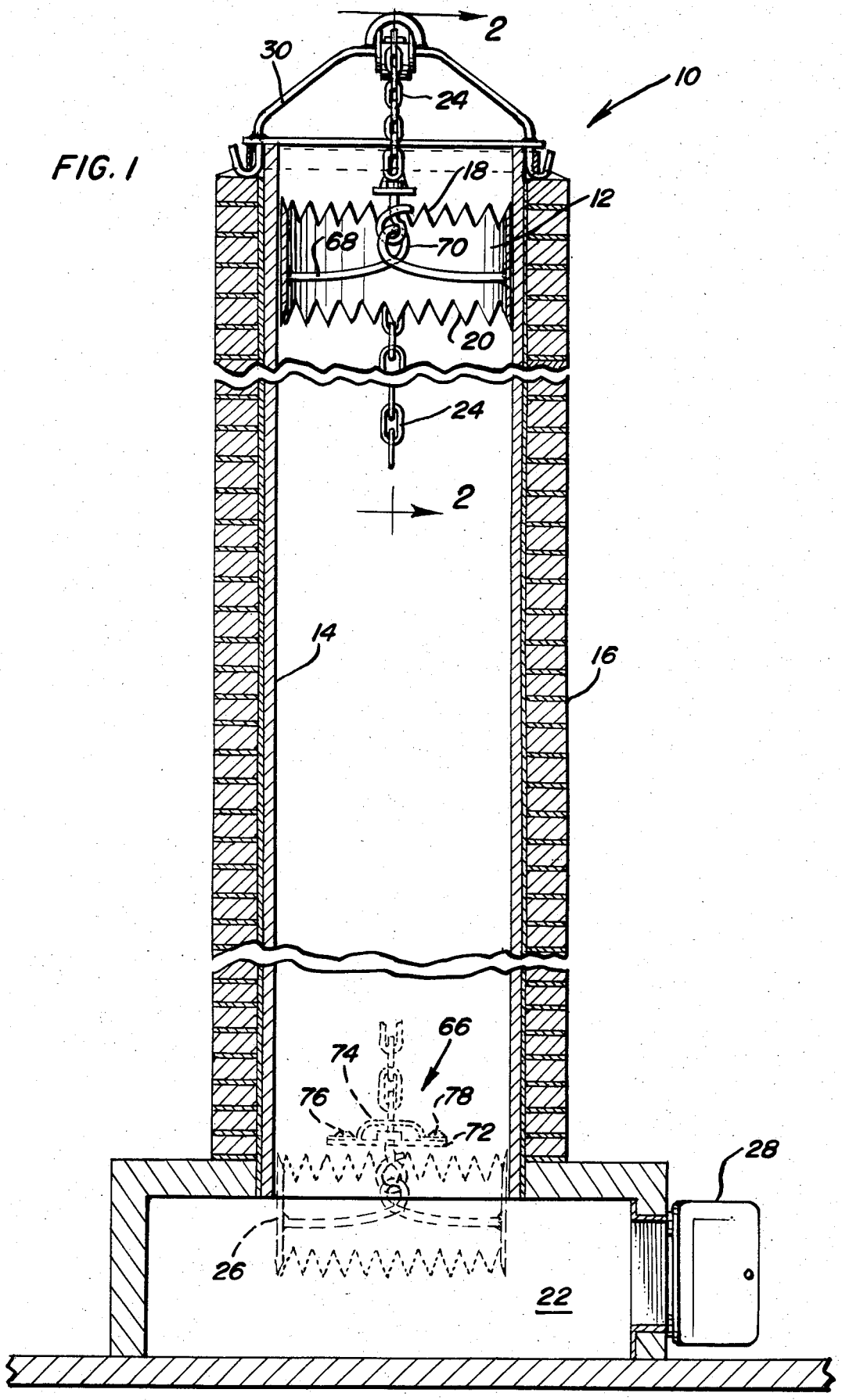
FIG. 1 is an elevation view, partly in cross-section, illustrating the attachment of the mounting bracket assembly forming the present invention to a conventional chimney.

With reference now to the drawings and in particular to FIG. 1 thereof, a preferred embodiment of the creosote cutter mounting bracket assembly embodying the principles and concepts of the present invention and generally designated by the reference numeral 10 will be described. In the interest of brevity, reference should be had to the disclosure of U.S. Pat. No. 4,409,703, incorporated herein by reference, for a complete understanding of the design and function of a creosote cutter 12 operably positioned within the flue 14 of a chimney 16. The present invention deals only with the mounting bracket assembly 10 and not with the specific design and use of the creosote cutter 12 and the discussion relative thereto is thus limited.

As shown, however, the cutter 12 includes a plurality of topmost positioned cutting teeth 18 and a further plurality of bottommost cutting teeth 20 with the function of such teeth being to scrape away creosote and other debris which accumulates on the inside surface of the flue 14 as the result of a combustion process occurring within a firebox 22. The cutter 12 is typically designed to conform to the interior shape of the flue 14 so as to facilitate the movement of the cutter upwardly and downwardly within the flue. In this regard, the cutter 12, which is shown as being positioned near a topmost portion of the flue 14 in FIG. 1, may be selectively manually moved through a pulling of the chain 24 downwardly within the flue until the cutter reaches a position 26 as indicated by phantom lines. Of course, through a further manual operation of the chain 24, the cutter 12 may be returned to its topmost position within the chimney 16, and such manual operation may be accomplished from a position exterior of the chimney or alternatively, an interior operation may be accomplished by an operator by his achieving access to the chain through an access or cleanout door 28. A more complete description of the interior and exterior operable positioning of the chain 24 is given in U.S. Pat. No. 4,409,703.

Figure 2:
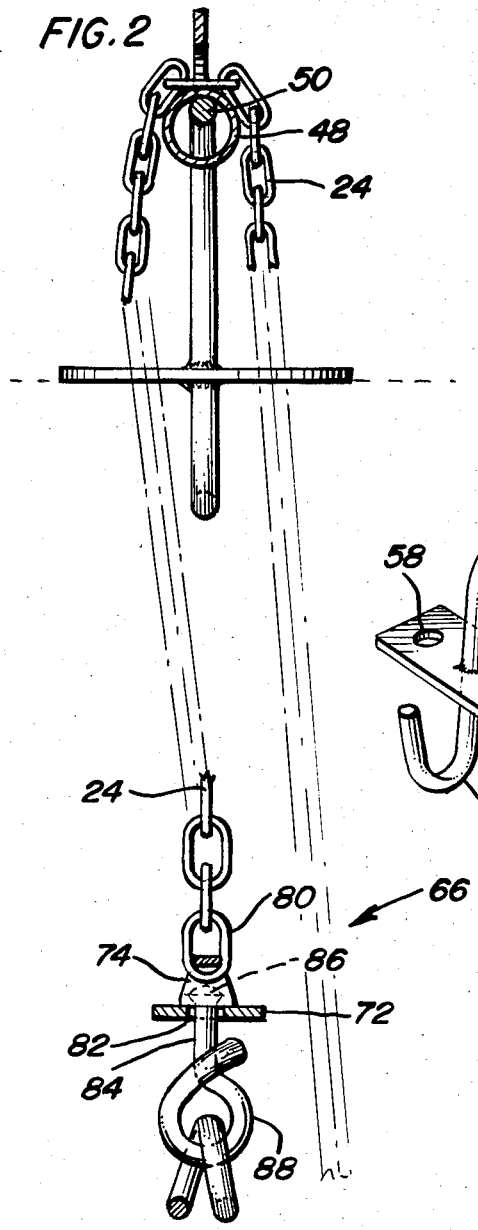
FIG. 2 is a partial cross-sectional detail view taken along the line 2—2 in FIG. 1.
Figure 3:
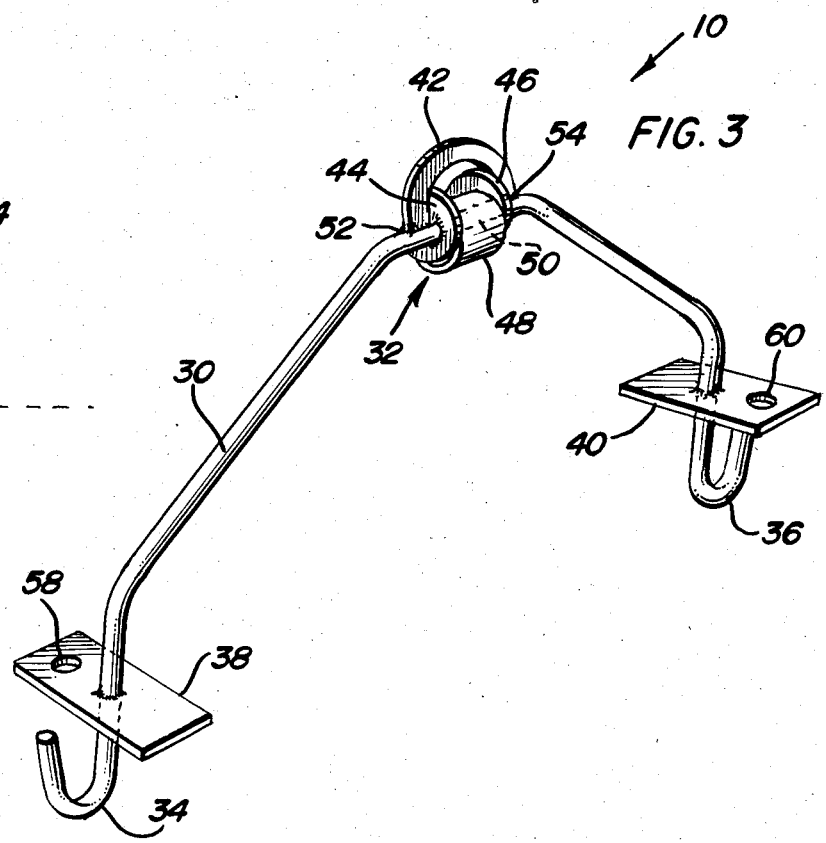
FIG. 3 is a perspective view of the mounting bracket forming a part of the present invention.

Referencing FIGS. 2 and 3 in conjunction with FIG. 1, it can be seen that the mounting bracket assembly 10 includes a bracket bar 30 which is designed to be mounted across the top opening of the flue 14. The bracket bar 30 is of a substantially integral construction, and includes a roller or pulley assembly 32 and a pair of oppositely positioned banding guides 34, 36. The bracket bar 30 further includes a pair of fixedly attached support plates 38, 40 and a chain guide member 42.

With respect to the construction of the roller or pulley assembly 32, it will be noted that the bracket bar 30 may be formed from a continuous metallic bar and may have a pair of substantially circular, spaced-apart metallic stops 44, 46 fixedly attached thereto. Prior to the attachment of the stops 44, 46 to the bar member 30, a short length of metallic conduit 48 is positioned therebetween whereby it is loosely supported by and movable relative to the bar member 30. Once the stops 44, 46 are fixedly secured in position, axial movement of the conduit 48 along the bar member 30 is prevented, while the conduit is freely rotatable about a section 50 of the bar member, as defined by the space between the stops 44, 46, inasmuch as no fixed securement of the conduit to the bar section 50 is effected. As such, the conduit 48 operates as a pulley and, as best shown in Figure 2, the large diameter of the conduit 48 relative to the diameter of the bar section 50 facilitates an erratic and transverse rotatable movement of the conduit in response to the uneven forces generated by the individual chain links of the chain 24. More specifically, it can be appreciated that a conventional pulley would have an internal diameter which would normally be only slightly greater than the diameter of the bar section 50 and which would normally then result in an erratic movement of the chain 24 over the pulley, since the individual chain link sections vary greatly in size. Through the use of the greater diameter conduit section 48, this erratic chain movement is translated to the conduit, i.e., the conduit pulley moves freely and erratically with respect to the bar section 50, so as to result in a more even and smooth movement of the chain 24.

Further illustrated in FIGS. 1, 2 and 3 is the aforementioned chain guide 42. The chain guide 42 may be of a semi-circular construction with its remote ends 52, 54 being fixedly secured to the bar section 50 on the opposed respective sides of the stops 44, 46. In this connection, any conventional attachment means, such as welding or the like, can be utilized to attach the chain guide to the bracket bar 30, while the same or different conventional attachment means can be utilized to fixedly secure the aforedescribed stops 44, 46 in position. While the stops 44, 46 would normally function to prevent a chain 24 from becoming disengaged from the roller assembly 32, the chain guide 42 is provided to further assure that a chain does not become disengaged from the pulley assembly. In effect, the chain guide 42, in combination with the stops 44, 46, defines an aperture through which the chain 24 may be directed and which absolutely prevents chain disengagement from the pulley assembly 32.

As best shown in FIGS. 1 and 3, the banding guides 34, 36 positioned at respective ends of the bracket bar 30 are of a U-shaped configuration and are designed to lie in juxtaposition to an external surface of the flue 14.

Figure 5:
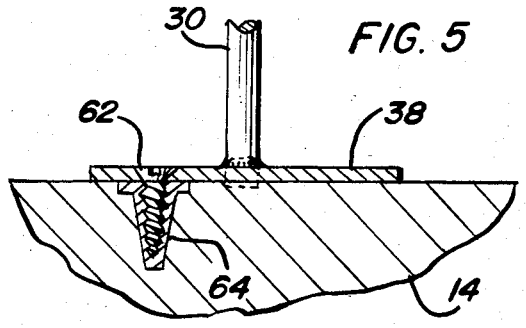
FIG. 5 is a detail view, partly in cross-section, illustrating the operable attachment of the support plate forming a part of the present invention.
Figure 4:
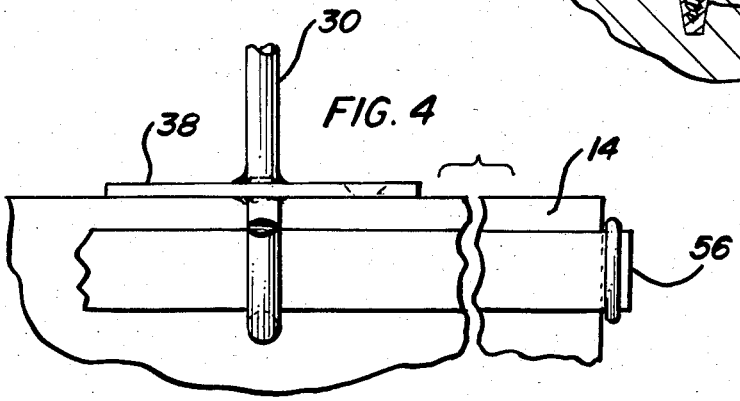
FIG. 4 is a side detail view illustrating the banding guides forming a part of the present invention.

When so positioned, the respective support plates 38, 40 will normally lie on a topmost portion of the flue 14 and of course, the rigid construction of the bracket bar 30 will require that it be predesigned and sized to fit the particular flue 14. As shown in FIGS. 1 and 4 then, once the banding guides 34, 36 are juxtaposed next to the flue structure 14 and the respective support plates 38, 40 lie in a supporting relationship on top of the flue, one or more strips of banding iron 56 may be directed through the banding guides in the illustrated manner. The banding iron 56 is designed to be tightly fitted about the flue 14 so as to firmly secure the mounting bracket assembly 10 in an operable position over the flue. As shown in FIGS. 3 and 5, the support plates 38, 40 are provided with respective through-extending apertures 58, 60. If desired, threaded fasteners 62 may be directed through the apertures 58, 60 to facilitate a further fixed securing of the bracket bar 30 to the chimney flue 14. Inasmuch as the flue 14 will normally be of a stone material construction, some type of special insert 64 may be prepositioned within the flue whereby the threaded fastener 62 may be securely fastened to the conventional insert.

FIGS. 1 and 2 further illustrate a novel connector assembly 66 which may be employed to connect the chain 24 to the cutter 12. In this regard, as discussed in the inventor's prior U.S. Pat. No. 4,409,703, the cutter 12 will normally have a fixedly attached cross-extending support bar 68. The metallic support bar 68 will be bent to form a loop 70 designed to facilitate an attachment of the chain 24 to the cutter 12. To facilitate this attachment, the connector assembly 66 may include a rectangularly-shaped plate member 72 having a metallic loop 74 fixedly secured to a topmost portion thereof. The metallic loop 74 in the preferred embodiment of the invention is attached to the plate 72 by a pair of rivets 76, 78 directed through the respective ends of the loop and through the plate. As best illustrated in FIG. 2 then, an end link 80 of the chain 24 may have the metallic loop 74 directed therethrough prior to a final riveting of the loop to the plate 72.

With further reference to FIGS. 1 and 2, the plate 72 is illustrated with a through-extending aperture 82 positioned under the loop member 74 and a piece of soft bar stock 84 may be directed upwardly through the aperture and flared at its end 86 so as to prevent its disengagement from the plate 72. The soft bar stock 84 may then have its remaining free end bent into a loop 88 with the support loop 70 passing therethrough. As such, the loop 88 is operably and fixedly secured to the support bar 68, thereby to connect the creosote cutter 12 to the chain 24.

A final noteworthy feature of the present invention is best illustrated in FIG. 1, wherein it can be seen that the bracket bar 30 extends upwardly above the topmost portion of the flue 14 in a manner whereby the pulley assembly 32 is substantially above the topmost portion of the chimney. The height of the pulley assembly 32 is carefully selected so that the creosote cutter 12 can be moved upwardly to a topmost portion of the flue 14 without the cutter being actually drawn completely out of the chimney. Two different safeguards are provided to prevent the creosote cutter 12 from coming out of the top of the flue 14. A first safeguard is formed by plate 72, as shown in FIG. 2, which, after the cutter 12 has been raised to its topmost position, will slide around the pulley assembly 32 and come into engagement with the stops 44, 46 and the chain guide 42. Once the plate 72 is in abutment thereagainst, no further movement of the cutter 12 upwardly within the flue can be undertaken. Operable in conjunction with this first safeguard, or independent therefrom, the bracket bar 30 is designed to gradually slope upwardly from its support plates 38, 40 to its roller assembly 32. This gradual upward slope of the bar 30 from its respective ends constitutes the second safeguard whereby the topmost cutting tooth section 18 of the cutter 12 will come into engagement with the sloping portions of the bracket bar prior to a total removal of the cutter from the chimney flue 14. In effect then, the cross-extending, upwardly-sloping sections of the bracket bar 30 serve as a stop against which the cutter 12 will come into abutment before it is drawn completely out of the chimney 16.

While the manner of operation of the present invention should now be apparent with reference to the above description, a brief summary thereof will be provided. In this respect, it can be seen that a user of the mounting bracket assembly 10 comprising the present invention need only to position the bracket bar 30 over the topmost portion of a chimney flue 14, as best shown in FIG. 1, and then attach a strip of banding iron 56 through the banding guides 34, 36 and around an exterior surface of the flue to effectively secure the bracket assembly in position. With the connector assembly 66 attached to a creosote cutter 12 contained within the flue 14, the support chain 24 may then be directed over the conduit section 48 through the chain guide 42 whereby an operator can then pull the chain from either interiorly or exteriorly of the chimney 16 so as to effect a desired up and down cleaning movement of the cutter 12 within the flue 14. In the event that the cutter 12 is drawn to its topmost position within the flue 14, the cutter may come into contact with the upwardly-sloping portions of the bracket bar 30 so as to be prevented from being drawn out of the flue, while the plate 72 may also effectively come into blocking contact with the chain guide 42 to prevent further upward movement of the cutter within the flue. A continual and even movement of the cutter 12 upwardly and downwardly within the flue 14 is effected by the use of the conduit 48 in place of a conventional pulley inasmuch as the conduit can move in multiple directions to compensate for the uneven and irregular conventional construction of the chain 24.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved chimney cleaner mounting bracket assembly comprising:

a bracket bar positionable across a topmost portion of said chimney;

pulley means substantially centrally positioned on said bracket bar, said pulley means comprising a length of cylindrical conduit, said bracket bar being unattachably directed through an interior portion of said conduit, said conduit having an interior diameter substantially greater than a dimensional diameter of said bracket bar, said conduit hanging freely upon a horizontal portion of said bracket bar, said pulley means being operable to receive a supporting chain for said chimney cleaner and having the same directed thereover, said pulley means being erratically radially movable in multiple directions relative to said bracket bar, thereby to compensate for irregular axial movement of said supporting chain during a movement of said chimney cleaner within said chimney;

a support plate fixedly attached to said bracket bar and being positionable on a topmost surface of said chimney; and a banding guide forming a part of said bracket bar and being designed to receive a banding iron for fixedly securing said chimney cleaner mounting bracket assembly to said chimney.

2. The new and improved chimney cleaner mounting bracket assembly as defined in claim 1, and further including stop means for limiting axial movement of said conduit along said bracket bar means.

3. The new and improved chimney cleaner mounting bracket assembly as defined in claim 2, wherein said stop means comprise first and second orthogonally-positioned, spaced-apart plates fixedly secured to said bracket bar, said conduit hanging freely on a portion of said bracket bar between said first and second plates.

4. The new and improved chimney cleaner mounting bracket assembly as defined in claim 3, and further including chain guide means for preventing a chimney cleaner supporting chain from becoming disengaged from said conduit.

5. The new and improved chimney cleaner mounting bracket assembly as defined in claim 4, wherein said chain guide means comprises a loop member having its respective ends fixedly secured to said bracket bar proximate exterior surfaces of said first and second spaced-apart plates.

6. the new and improved chimney cleaner mounting bracket assembly as defined in claim 2, and further including chain guide means for preventing a disengagement of a chimney cleaner supporting chain from said conduit.

7. The new and improved chimney cleaner mounting bracket assembly as defined in claim 6, wherein said chain guide means comprises a metallic loop having respective ends thereof fixedly attached to said bracket bar, said conduit being positioned between said respective ends of said loop.

8. The new and improved chimney cleaner mounting bracket assembly as defined in claim 6, wherein said chain guide means further operates to limit upward movement of said chimney cleaner within said chimney, thereby to prevent said chimney cleaner from coming out of said chimney.

9. The new and improved chimney cleaner mounting bracket assembly as defined in claim 1, and further including connector means for effecting a connection between said chimney cleaner and a supporting chain.

10. The new and improved chimney cleaner mounting bracket assembly as defined in claim 9, wherein said connector means comprises a plate member having a first connector loop fixedly secured to a topmost surface thereof, said chain being attached to said first connector loop, and further having a second connector loop attached to a bottommost portion thereof, said chimney cleaner being attached to said second connector loop.

11. The new and improved chimney cleaner mounting bracket assembly as defined in claim 10, wherein said first connector loop is attached to said plate member by first and second rivets directed through respective ends of said first connector loop and said plate member.

12. The new and improved chimney cleaner mounting bracket assembly as defined in claim 11, wherein said second connector loop comprises a metallic rod having first and second ends, said first end being directed through an aperture in said plate member and then being flared so as to prevent a removal of said first end from said aperture, said second end being formed in a loop through which a connecting portion of said chimney cleaner may be directed to effect a connection of said chimney cleaner to said second connector loop.

13. The new and improved chimney cleaner mounting bracket assembly as defined in claim 10, wherein said plate member comprises a chimney cleaner movement stop means, said plate member being engageable with a chain guide means positioned proximate said pulley means when said chimney cleaner reaches its topmost desired position within said chimney, thereby to prevent said chimney cleaner from coming out of said chimney.

14. The new and improved chimney cleaner mounting bracket assembly as defined in claim 1, and further including chimney cleaner movement stop means.

15. The new and improved chimney cleaner mounting bracket assembly as defined in claim 14, wherein said chimney cleaner movement stop means comprises a chain guide means associated with said pulley means.

16. The new and improved chimney cleaner mounting bracket assembly as defined in claim 14, wherein said chimney cleaner movement stop means comprises said bracket bar.

17. A new and improved chimney cleaner mounting bracket assembly comprising:

a bracket bar positionable across a topmost portion of said chimney, said bracket bar functioning to support said chimney cleaner within said chimney and further operating as a first chimney cleaner movement stop means to limit upward movement of said chimney cleaner within said chimney;

pulley means substantially centrally positioned on said bracket bar, said pulley means comprising a length of metallic tubing having said bracket bar directed therethrough, said metallic tubing hanging freely on said bracket bar and being retained in position by a pair of stops fixedly secured to said bracket bar at respective ends of said metallic tubing, said metallic tubing being erratically radially movable relative to said bracket bar in response to a movement of a cleaner supporting chain movably positioned thereover;

chain guide means fixedly secured to said bracket bar and looped over said pulley means, thereby to prevent an undesired disengagement of said support chain from said pulley means, said chain guide means further serving as a second chimney cleaner movement stop means, whereby a chimney cleaner connector means will come into engagement with said chain guide means when said chimney cleaner is at its topmost desired position within said chimney;

a support plate fixedly attached to said bracket bar and being positionable on a topmost surface of said chimney, said support plate comprising first and second orthogonally-positioned plates fixedly secured to respective ends of said bracket bar; and a banding guide forming a part of said bracket bar and being designed to receive a banding iron for fixedly securing said chimney cleaner mounting bracket assembly to said chimney, said banding guide comprising first and second U-shaped ends of said bracket bar.

18. The new and improved chimney cleaner mounting bracket assembly as defined in claim 17, wherein said chimney cleaner connector means comprises a plate member having a first connector loop on one surface to which said supporting chain is connected and a second connector loop on an opposed surface to which said chimney cleaner is connected.

* * * * *